US005540158A

United States Patent [19]

Ford

[11] Patent Number: 5,540,158

[45] Date of Patent: Jul. 30, 1996

[54] SECTIONAL FOLDING TABLE

[76] Inventor: Henry E. Ford, 6055 N. River Run Dr., Sebastian, Fla. 32958

[21] Appl. No.: 297,124

[22] Filed: Aug. 29, 1994

[51] Int. Cl.[6] ..... A47B 3/00

[52] U.S. Cl. ..... 108/115; 108/162; 108/44; 108/125; 248/439

[58] Field of Search ..... 108/115, 162, 108/163, 176, 129, 131, 132, 44, 65, 69, 59, 35, 36, 40, 125, 126; 248/439

[56] References Cited

U.S. PATENT DOCUMENTS

| | | | |
|---|---|---|---|
| 1,130,760 | 3/1915 | Paffrath | 248/439 |
| 2,228,203 | 1/1941 | Hoffmann | 108/44 X |
| 2,451,275 | 10/1948 | Cercownay | 108/44 X |
| 2,471,730 | 5/1949 | Doerr | 108/44 X |
| 2,496,094 | 1/1950 | Johnson | 108/115 X |
| 2,683,069 | 7/1954 | Kimmel | 108/125 X |
| 2,755,152 | 7/1956 | Calgy | 108/69 X |
| 3,394,666 | 7/1968 | Pearlman | 108/129 |
| 3,709,159 | 1/1973 | Oglesby, Jr. | 108/44 |
| 4,144,822 | 3/1979 | Roberts et al. | 108/125 X |
| 4,236,461 | 12/1980 | Barksdale | 108/44 |
| 4,443,034 | 4/1984 | Beggs | 108/44 X |
| 4,494,465 | 1/1985 | Fick, Jr. | 108/44 |
| 4,993,088 | 2/1991 | Chudik | 5/118 |
| 5,090,335 | 2/1992 | Russel | 108/44 |
| 5,239,934 | 8/1993 | Miller et al. | 108/44 |

FOREIGN PATENT DOCUMENTS

| | | | |
|---|---|---|---|
| 657694 | 12/1964 | Belgium | 108/44 |
| 110684 | 5/1944 | Sweden | 108/162 |

*Primary Examiner*—Peter M. Cuomo
*Assistant Examiner*—Janet M. Wilkens
*Attorney, Agent, or Firm*—Edward M. Livingston, Esq.

[57] ABSTRACT

A sectional folding table has a first-tabletop frame (3) with an outside periphery into which a second-tabletop frame (4) and foldable legs (16, 18) of the second-tabletop frame are pivotally foldable. An attachment side (20) of the first-tabletop frame is attachable to a separate structure such as a vehicle compartment (15), to another table or to other desired objects of a desired height as an option to primary legs (26, 27). Legs of both tabletop frames are attached pivotally to a joint side (10) and positioned in juxtaposed relationship for side-by-side pivotal folding. Several embodiments are shown.

17 Claims, 4 Drawing Sheets

FIG. 1
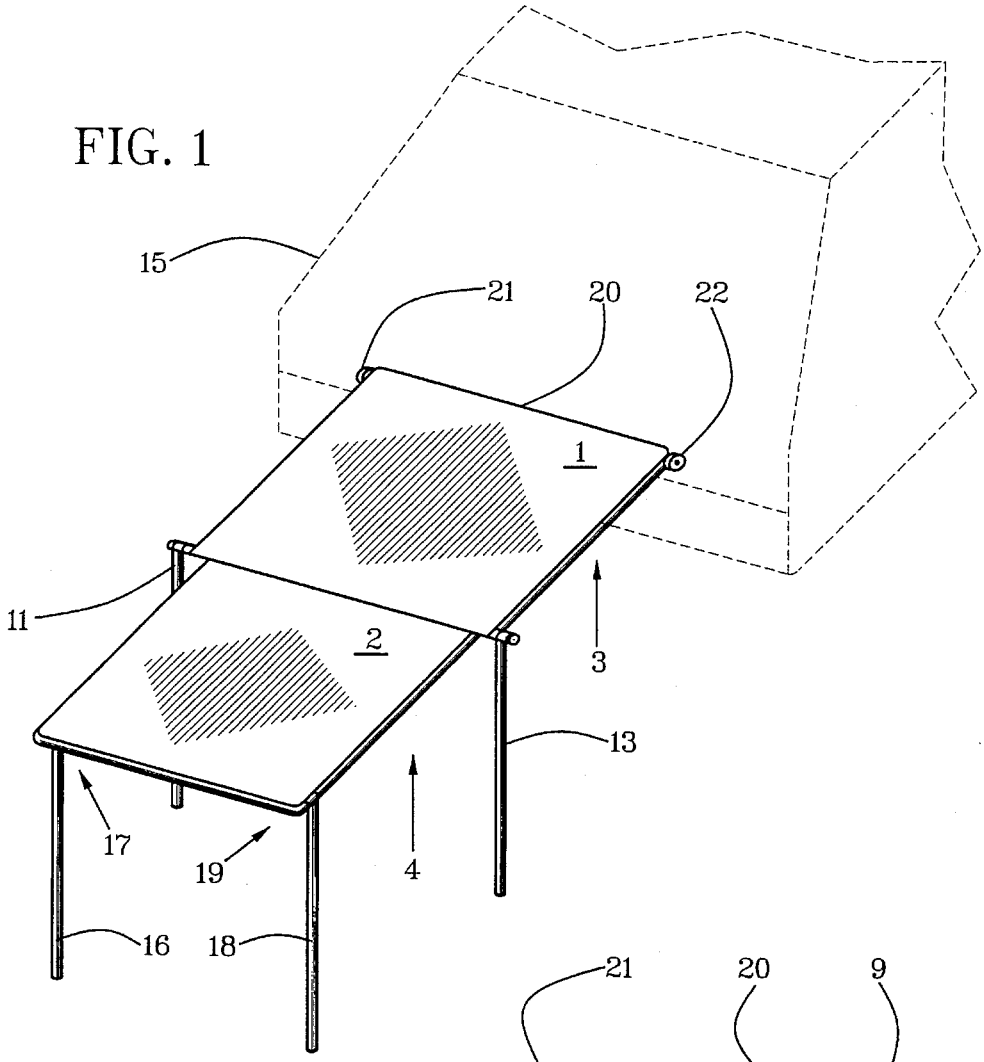
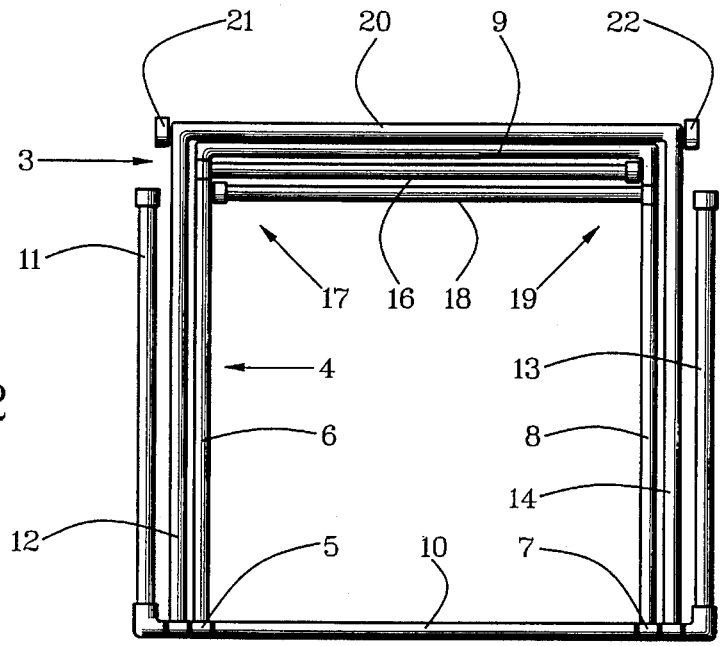
FIG. 2

SECTIONAL FOLDING TABLE

BACKGROUND OF THE INVENTION

This invention relates to folding tables and in particular to folding tables having a plurality of tops that are foldable within an outside perimeter of a single top section for ease of portability and extension from other structures such as a vehicle, another table, steps, railing, wheel chair or indigent cave for such uses as vehicle-platform extensions, picnics, card playing, festivals, flea-market sales, shows and exhibits.

Previously, there have been a wide variety of folding tables attachable to or extendable from a separate structure. None, however, are known to have dual tops that are foldable within confines of a single top in a manner taught by this invention. Examples of different but related foldable and vehicle-attachable tables include a table for a truck bed described in U.S. Pat. No. 5,090,335 by Russell, issued Feb. 25, 1992. The Russell device is a single-top table that fits in a pickup truck and has legs extendable at portions not held up by a bed of the pickup truck when slid out to where end one is supported by the pickup truck. It also provided ramp access to the pickup truck with the legs folded up and with one end on a ground surface. U.S. Pat. No. 4,993,088, by Chudik, issued Feb. 19, 1991, describes a table extendable from a pickup truck similar to the Russell table but with different types of legs. U.S. Pat. No. 5,239,934, by Miller, et al., issued Aug. 31, 1993, taught a work-shop table slidable from a pickup truck and having wheels on legs extendible to support and to move the table when off of the pickup truck. A sectional folding table having an end attachable to a separate structure is described in U.S. Pat. No. 2,471,730, by Doerr, issued May 31, 1949. The Doerr device, however, was limited to having one end supported by a luggage compartment of an automobile. It was limited further to legs, slide ways, hinging means and other components different than taught by this invention. Other known prior-art folding tables attachable to a separate structure are further yet different.

SUMMARY OF THE INVENTION

In light of problems that have existed and that continue to exist in this field, objectives of this invention are to provide a sectional folding table which:

Folds within peripheral confines of one tabletop;

Has legs of a plurality of tabletops that fold within peripheral confines of one tabletop;

Has one end supportable optionally by a separate structure;

Is convenient to operate, light, portable and has optional luggage wheels; and

Fits within a motor-vehicle trunk or compartment.

This invention accomplishes the above and other objectives with a sectional folding table having a first section with an outside periphery into which a second section and foldable legs of the second section are pivotally foldable. One edge of the first section is attachable to a separate structure such as a vehicle compartment, another table or other object of a desired height as an option to legs. Legs of both sections are attached pivotally and positioned in juxtaposed relationship for side-by-side pivotal folding.

BRIEF DESCRIPTION OF THE DRAWINGS

This invention is described by appended claims in relation to description of a preferred embodiment with reference to the following drawings which are described briefly as follows:

FIG. 1 is a perspective view of this sectional folding table in working relationship to a vehicle compartment;

FIG. 2 is a top view of a folded framework without tabletops;

DESCRIPTION OF PREFERRED EMBODIMENT

Figure 3:
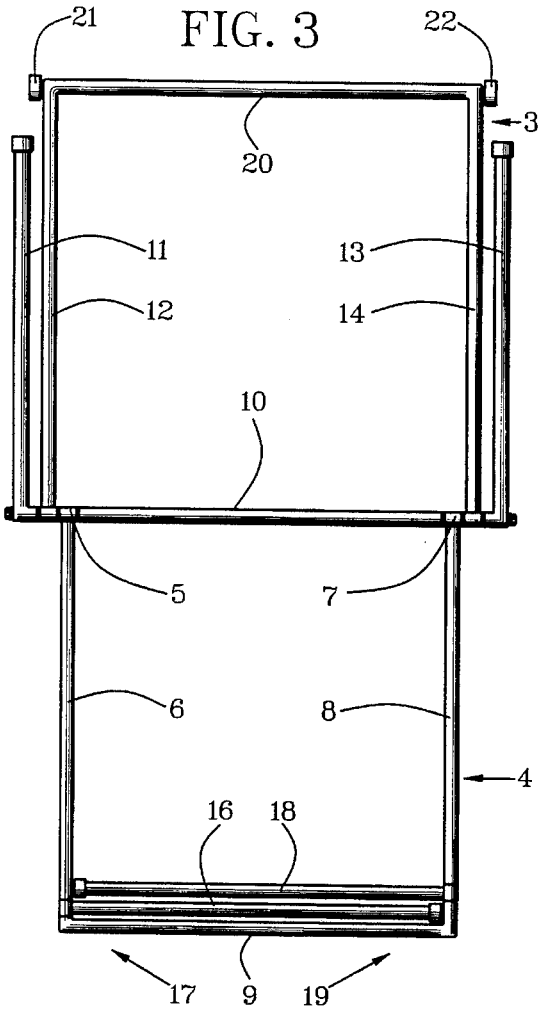
FIG. 3 is a top view of an unfolded framework without tabletops.

Reference is made first to FIGS. 1–2. A sectional folding table has a first tabletop 1 and a second tabletop 2 that are generally rectangular. The first tabletop 1 is attached to a top side of a first-tabletop frame 3 and the second tabletop 2 is attached to a second-tabletop frame 4. The first-tabletop frame 3 and the second-tabletop frame 4 are joined pivotally by means of a first joint end 5 on a first side 6 of the second-tabletop frame 4 and a second joint end 7 on a second side 8 of the second-tabletop frame 4 that are extended perpendicularly from a third side 9 of the second-tabletop frame 4 and attached pivotally to a joint side 10 that is a frame side common to the first-tabletop frame 3 and the second-tabletop frame 4.

A first middle leg 11 is attached pivotally to the joint side 10 at a design position relative to a first side 12 of the first-tabletop frame 3 and relative to the first side 6 of the second-tabletop frame 4. A second middle leg 13 is attached pivotally to the joint side 10 at a design position relative to a second side 14 of the first-tabletop frame 3 and relative to the second side 8 of the second-tabletop frame 4. In this embodiment, the first middle leg 11 and the second middle leg 13 are positioned laterally outside of the first-tabletop frame 3 in an unfolded mode. In other embodiments, such as described in relation to FIG. 9, the first middle leg 11 and the second middle leg 13 are positioned laterally inside of the tabletop frames 3 and 4.

The first middle leg 11 and the second middle leg 13 are juxtaposed in parallel relationship to the tabletop frames 3 and 4 in a folded mode for being stored or positioned in such places as a vehicle compartment 15. In unfolded mode, the middle legs 11 and 13 are positioned in designed degrees of perpendicularity relative to the tabletop frames 3 and 4.

A first extension leg 16 is attached pivotally to the second-tabletop frame 4 at a design position relative to a first extension corner 17 of the second-tabletop frame 4. A second extension leg 18 is attached pivotally to the second-tabletop frame 4 at a design position relative to a second extension corner 19 of the second-tabletop frame 4. In this embodiment, the first extension leg 16 is attached pivotally to the first side 6 of the second-tabletop frame 4 and the second extension leg 18 is attached pivotally to the second side 8 of the second-tabletop frame 4. In an embodiment described in relation to FIG. 9, the extension legs 16 and 18 are attached to the third side 9 of the second-tabletop frame 4. In either embodiment, the extension legs 16 and 18 are parallel to both tabletop frames 3 and 4 in a folded mode and designedly perpendicular to both tabletop frames 3 and 4 in an unfolded mode.

One intended use of this sectional folding table is as a tailgate table for a motor vehicle. For this use, an attachment side 20 of the first-tabletop frame 3 is positioned on a structure such as a floor in a vehicle compartment 15. The middle legs 11 and 13 and the extension legs 16 and 18 are then unfolded as depicted in FIG. 1. To facilitate sliding in-and-out of a car or other storage facilities, a first luggage-type wheel 21 is attached rotationally to the first side 12 of the first-tabletop frame 3 proximate the attachment side 20 and a second luggage-type wheel 22 is attached rotationally to the second side 14 proximate the attachment side 20 of the first-tabletop frame 3. To stop the wheels 21 and 22 from causing the table to roll from the back of the vehicle 15, one or more steps or ridges (not shown) can be placed in the rear floor of the vehicle 15.

Sides of frames 3 and 4 can be cylindrical, square, rectangular, channelled or other structural-beam form desirable for various use conditions and cost factors. Cylindrical tubing is illustrated as a preferred structural-beam form. Materials also can be selected from a wide variety of options such as aluminum, plastic and iron. The tabletops 1 and 2 can be constructed of various wood, composite, aluminum, plastic and other suitable materials. Thickness of tops can be in accordance with design requirements for the particular materials employed. Whether or not the tabletops 1 and 2 are extended over sides of frames 3 and 4 is a design factor in relation to materials and thickness of materials. Conventional joining methods can be employed for all components.

Figure 4:
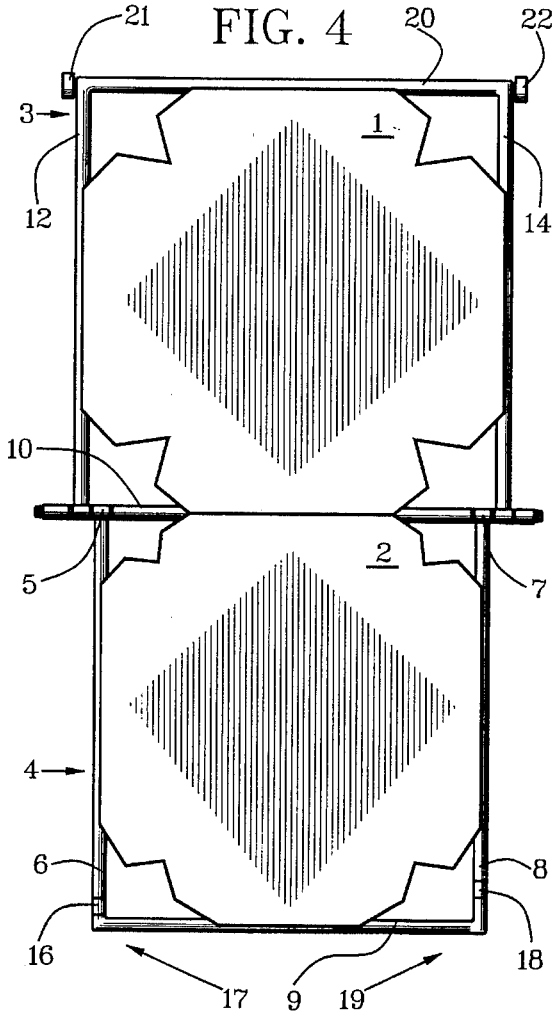
FIG. 4 is a top view of an unfolded framework with tabletops and cutaway sections in the tabletops to illustrate working relationships of frame components and legs.
Figure 5:
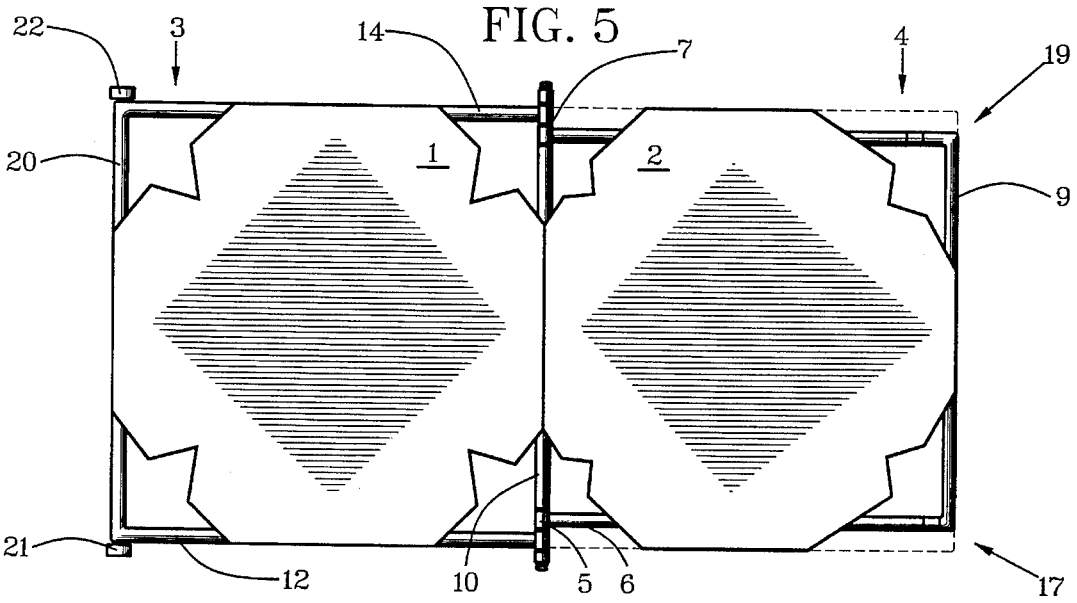
FIG. 5 is the FIG. 4 illustration with wide first and second tabletops having equal widths.

Reference is made now to FIGS. 3–5. The sectional folding table is shown without tabletops 1 and 2 in FIG. 3 to illustrate working relationships of frame and leg components in an unfolded mode. In FIG. 4, corner portions of the first tabletop 1 and the second tabletop 2 are cut away to reveal corner construction in an unfolded mode. In FIG. 5, the first tabletop 1 is extended to outside edges of frame sides 12, 14 and 20 as a design preference for particular applications. Also in FIG. 5, the second tabletop 2 is extended to the same widths as the first tabletop 1 for particular design preferences. On all but the joint side 10, the tabletops 1 and 2 can be extended to and beyond respective edges of the frames 3 and 4.

Figure 6:
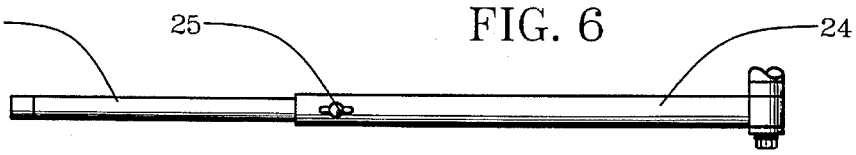
FIG. 6 is a leg with a length-adjustment means.

In FIG. 6, an optional length-adjustment means is shown for adjusting lengths of legs 11, 13, 16 and 18. A leg extension 23 is positional and adjustable telescopically inside of a base portion 24 of a leg. Arresting relationship of the leg extension 23 to the base portion 24 can be provided with a variety of fastener means such as a set screw 25 that is screwable through a wall of the base portion 24 against the leg extension 23.

Figure 7:
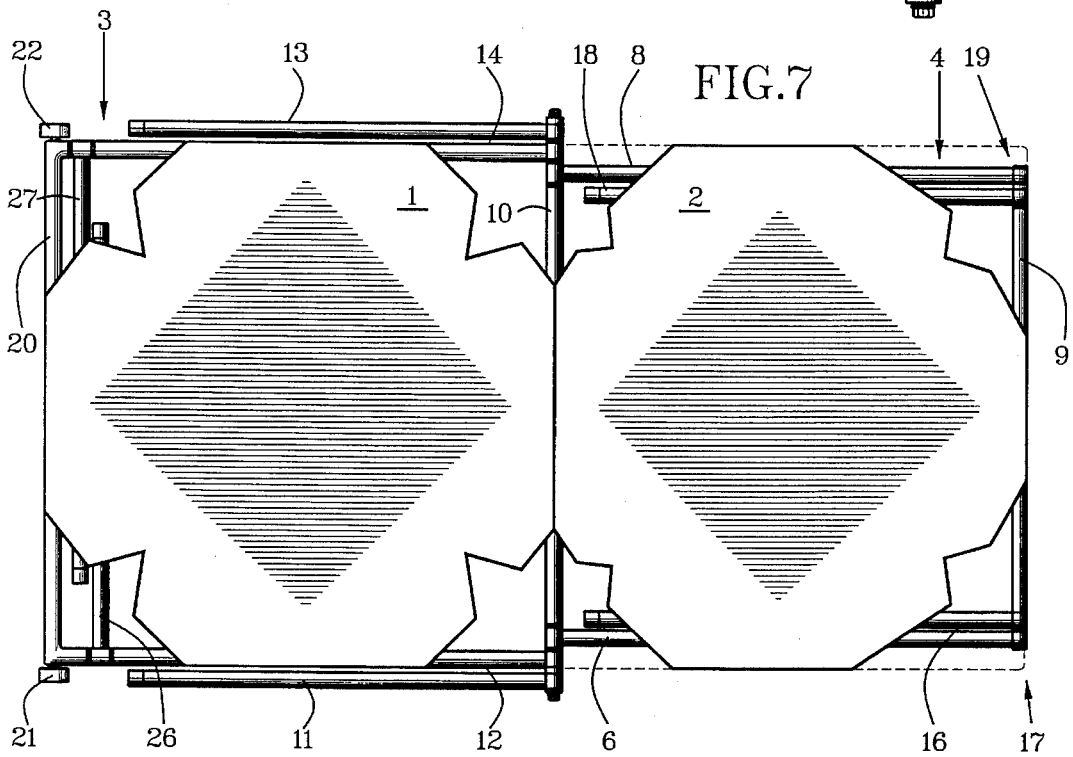
FIG. 7 is a partial cutaway top view of an embodiment having primary legs as an option to use inside or outside of other structures to support an attachment side.
Figure 8:
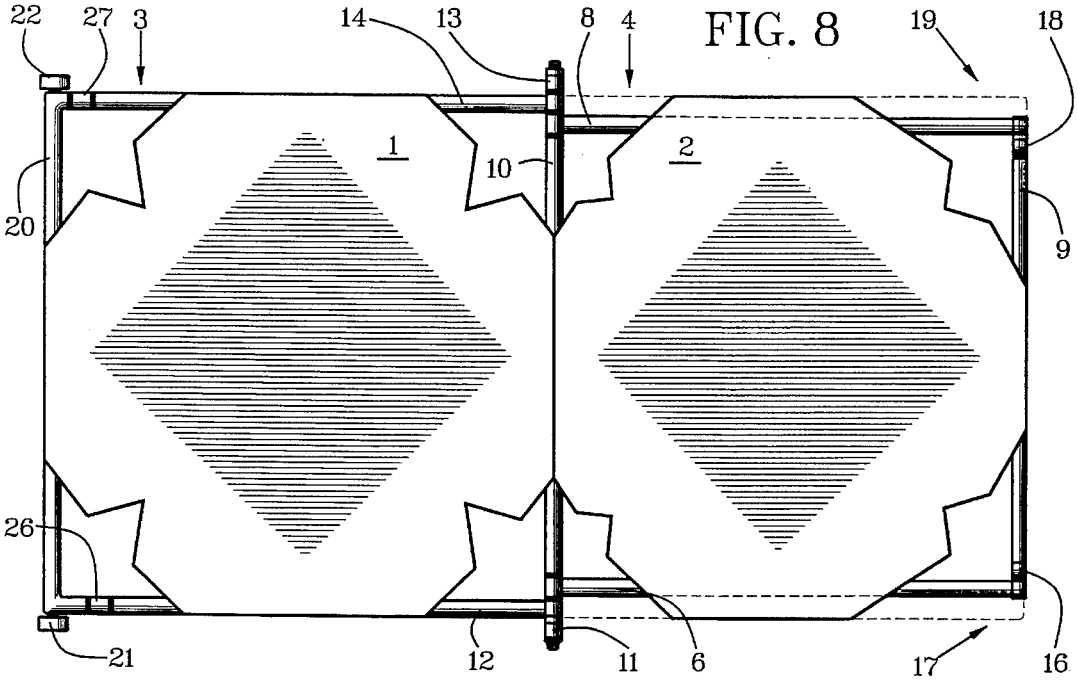
FIG. 8 is the FIG. 7 illustration with legs in unfolded mode.

Reference is made now to FIGS. 7–8. A first primary leg 26 and a second primary leg 27 are attached pivotally to the first side 12 and to the second side 14 respectively of the first-tabletop frame 3. The primary legs 26 and 27 are alternative to resting the attachment side 20 on a structure such as a vehicle compartment 15. Also for either embodiment, the first extension leg 16 and the second extension leg 18 can be attached pivotally to the third side 9 of the second-tabletop frame 4 at positions proximate the first extension corner 17 and the second extension corner 19, respectively.

Figure 9:
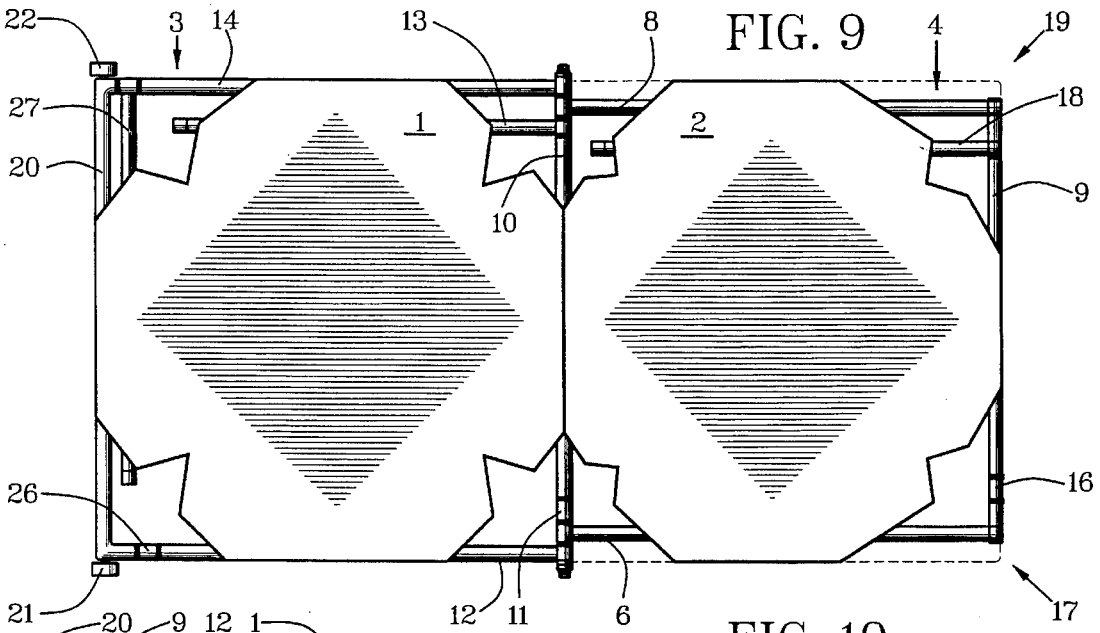
FIG. 9 is a partial cutaway view of an embodiment having inside middle legs and optional outside primary legs and having extension legs attached to a third side of a second-tabletop frame.

Referring to FIG. 9, the first middle leg 11 can be attached to the joint side 10 at a position that is inside of the first-tabletop frame 3 laterally. Similarly, the first extension leg 16 and the second extension leg 18 can be attached to the third side 9 of the second-tabletop frame 4 at positions proximate the first extension corner 17 and the second extension corner 19 respectively. Legs on a top side of this illustration are shown in folded mode and legs on a bottom side of the illustration are shown unfolded for brevity now that these components have been depicted in separate drawings above. Note that the legs are shown as being sufficiently short to fit within the respective frames 3 and 4. Also demonstrated graphically is positioning the first side 6 of the second-tabletop frame 4 between the first side 12 of the first-tabletop frame 3 and the first middle leg 11 at one side of the sectional folding table and positioning the second side 8 of the second-tabletop frame 4 between the second side 14 of the first-tabletop frame 3 and the second middle leg 13. This allows folding in juxtaposed relationship of the sides and the legs.

Figure 10:
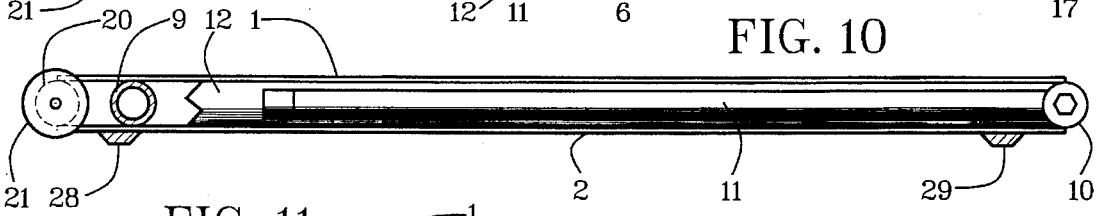
FIG. 10 is a partial cutaway side view of a folded sectional folding table having wheels and optional struts for raising the wheels from horizontal surfaces when the folding table is in a horizontal attitude.

Referring to FIG. 10 primarily and to FIGS. 1–9, first and second luggage struts 28 can be attached to bottom surfaces of first and second sides 12 and 14 respectively of the first-tabletop frame 3 at a design distance from the attachment side 20 for raising the luggage-type wheels 21 and 22 from a storage surface when not being moved on the luggage-type wheels 21 and 22. The first and second luggage struts 28 are made long enough to exceed distance from outside peripheries of the luggage-type wheels 21 and 22 to the storage surface. The luggage-type wheels 21 and 22 are employed by merely raising the joint side 10 to where the first and second luggage struts 28 are raised from the storage surface. Third and fourth luggage struts 29 can be positioned similarly on the first-tabletop frame 3 proximate the joint side 10 to provide a horizontal attitude of the sectional folding table in folded mode.

Also depicted in FIG. 10 is positioning of the first tabletop 1 and the second tabletop 2 vertically above and below the respective tabletop frames 3 and 4 to which they are attached. This same positioning occurs regardless of width of the tabletops 1 and 2 on all sides except for sides attached to the joint side 10. Sides of tabletops 1 and 2 attached to the joint side 10 can not be extended beyond center of the joint side 10.

Figure 11:
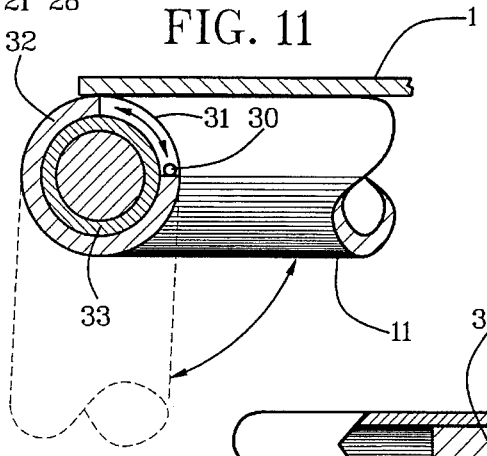
FIG. 11 is a sectional view of an optional leg-locking means for locking legs in a desired vertical attitude.

Referring to FIG. 11, legs of the sectional folding table can be locked into design vertical and horizontal attitudes by a variety of leg-locking means in combination with a variety of axle assemblies. One means is with a lock pin 30 in a part-circle channel 31 in a control sleeve 32 that is an extension of either side of the first-tabletop frame 3 or the second-tabletop frame 4. Rotating on an axle 33 extended from either of such sides, the lock pin 30 can be positioned designedly to maintain a design verticality. A preferred method for maintaining verticality is to design the part-circle channel 31 to allow a leg, such as first middle leg 11, to be slanted at an angle slightly greater than ninety degrees from horizontal relationship to a tabletop 1 or 2. Weight of the table and its contents are caused thereby to maintain all of the legs so slanted in their slanted attitude. Angles greater than ninety degrees for leg verticality and for pin rotation are indicated by double-ended arcuate arrows.

Figure 12:
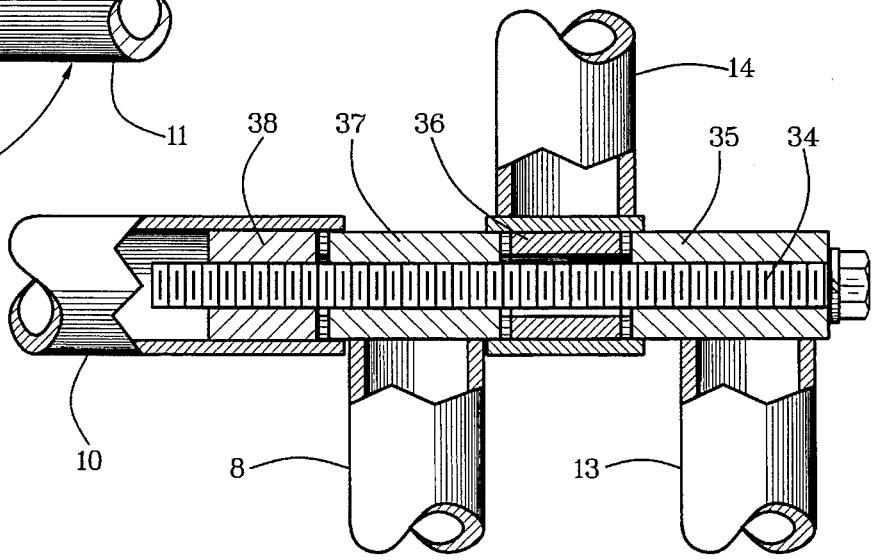
FIG. 12 is a cutaway sectional view of an optional axle means for relative rotational positioning of the legs and frames.

Reference is made now to FIG. 12. A preferred axle means for rotation of first and second sides 6 and 8 and for rotation of first and second middle legs 11 and 13 is shown by illustration for the second sides 8 and 14 in relation to middle leg 13. An axle bolt 34 is threaded through an outside nut 35, extended through an axle sleeve 36, threaded through an inside nut 37, and then threaded into a base nut 38 in the joint side 10. The axle bolt 34 may also be smooth by using retaining pins to frame numbers 10 and 14. A variety of other means also can be employed.

A new and useful sectional folding table having been described, all such modifications, adaptations, substitutions of equivalents, combinations of parts, applications and forms thereof as described by the following claims are included in this invention.

LIST OF COMPONENTS (For Convenience Of The Examiner)

1. first tabletop
2. second tabletop
3. first-tabletop frame
4. second-tabletop frame
5. first joint end on first side of second-tabletop frame
6. first side of the second-tabletop frame
7. second joint end of second side of second-tabletop frame
8. second side of second-tabletop frame
9. third side of second-tabletop frame
10. joint side
11. first middle leg
12. first side of first-tabletop frame
13. second middle leg
14. second side of first-tabletop frame
15. vehicle compartment
16. first extension leg
17. first extension corner
18. second extension leg
19. second extension corner
20. attachment side of first-tabletop frame
21. first luggage-type wheel
22. second luggage-type wheel
23. leg extension
24. base portion of leg
25. set screw
26. first primary leg
27. second leg
28. first and second luggage struts
29. third and fourth luggage struts
30. lock pin
31. part-circle channel
32. control sleeve
33. axle
34. axle bolt
35. outside nut
36. axle sleeve
37. inside nut
38. base nut

I claim:

1. A sectional folding table comprising:

a first tabletop attached to a top side of a first-tabletop frame that is rectangular;

a second tabletop attached to a top side of a second-tabletop frame that is rectangular;

the second-tabletop frame having a first joint end on a first side of the second-tabletop frame and a second joint end, on a second side of the second-tabletop frame extended perpendicularly from a third side of the second-tabletop frame and attached pivotally to a joint side that is a frame side common to the first-tabletop frame and to the second-tabletop frame;

the second-tabletop frame being sized and shaped to fit within an inside periphery of the first-tabletop frame with the second-tabletop frame pivoted from the joint side to a folded mode in which the first-tabletop frame and the second-tabletop frame are juxtaposed in substantially parallel relationship;

a first middle leg attached pivotally to the joint side at a design position relative to a first side of the first-tabletop frame and relative to the first side of the second-tabletop frame;

a second middle leg attached pivotally to the joint side at a design position relative to a second side of the first-tabletop frame and relative to the second side of the second-tabletop frame;

the first middle leg being juxtaposed in parallel relationship to the first side of the first-tabletop frame and juxtaposed in parallel relationship to the first side of the second-tabletop frame in a folded mode;

the second middle leg being juxtaposed in parallel relationship to the second side of the first-tabletop frame and juxtaposed in parallel relationship to the second side of the second-tabletop frame in a folded mode;

the first middle leg and the second middle leg having design degrees of perpendicularity relative to the first-tabletop frame in an unfolded mode;

a first extension leg attached pivotally to the second-tabletop frame at a design position relative to a first extension corner of the second-tabletop frame;

a second extension leg attached pivotally to the second-tabletop frame at a design position relative to a second extension corner of the second-tabletop frame;

the first extension leg being in parallel relationship to the second-tabletop frame in a folded mode;

the second extension leg being in parallel relationship to the second-tabletop frame in a folded mode;

the first extension leg and the second extension leg having design degrees of perpendicularity relative to the second-tabletop frame in an unfolded mode; and wherein all legs lie in the same horizontal plane when the table is in the folded mode.

2. A sectional folding table as described in claim 1 wherein:

the first tabletop is sized and shaped to fit within outside peripheral edges of the first-tabletop frame; and the second tabletop is sized and shaped to fit within outside peripheral edges of the second-tabletop frame, such that the first tabletop is wider than the second tabletop in a stepped-width relationship in unfolded parallel relationship.

3. A sectional folding table as described in claim 1 wherein:

the first tabletop is sized and shaped to fit over and beyond outside peripheral edges of the first-tabletop frame;

the second tabletop is sized and shaped to fit over outside peripheral edges of the second-tabletop frame; and the first tabletop is substantially equal in width to the second tabletop in unfolded parallel relationship.

4. A sectional folding table as described in claim 1 wherein:

the design position relative to the first side of the first-tabletop frame and relative to the first side of the second-tabletop frame at which the first middle leg is attached pivotally to the joint side is laterally outside of the first-tabletop frame; and the design position relative to the second side of the first-tabletop frame and relative to the second side of the second-tabletop frame at which the second middle leg is attached pivotally to the joint side is laterally outside of the first-tabletop frame, such that the first middle leg and the second middle leg pivot into the same horizontal plane as the first and second tabletop frames when the table is in a folded mode and into a plane perpendicular to the first and second table top frames when the table is in an unfolded mode at positions outward laterally from the first-tabletop frame.

5. A sectional folding table as described in claim 1 wherein:

the design position relative to the first side of the first-tabletop frame and relative to the first side of the second-tabletop frame at which the first middle leg is attached pivotally to the joint side is inside of the first-tabletop frame laterally; and the design position relative to the second side of the first-tabletop frame and relative to the second side of the second-tabletop frame at which the second middle leg is attached pivotally to the joint side is inside of the first-tabletop frame, such that the first middle leg and the second middle leg pivot into the same horizontal plane as the first and second tabletop frames when the table is in a folded mode and into a plane perpendicular to the first and second table top frames when the table is in an unfolded mode at positions inward from the first-tabletop frame.

6. A sectional folding table as described in claim 1 wherein:

the design position relative to a first extension corner of the second-tabletop frame at which the first extension leg is attached pivotally is on the first side of the second-tabletop frame proximate the first extension corner; and the design position relative to a second extension corner of the second-tabletop frame at which the second extension leg is attached pivotally is on the second side of the second-tabletop frame proximate the second extension corner; and the first extension leg and the second extension leg are juxtaposed in the same horizontal plane as the first and second tabletop frames when the table is in a folded mode and juxtaposed in a plane perpendicular to the first and second table top frames when the table is in art unfolded mode.

7. A sectional folding table as described in claim 1 wherein:

the design position relative to a first extension corner of the second-tabletop frame at which the first extension leg is attached pivotally is on the third side of the second-tabletop frame proximate the first extension corner; and the design position relative to a second extension corner of the second-tabletop frame at which the second extension leg is attached pivotally is on the third side of the second-tabletop frame proximate the second extension corner; and the first extension leg and the second extension leg are juxtaposed in design horizontal attitude in folded mode and juxtaposed in design verticality in unfolded mode at opposite sides of the second-tabletop frame.

8. A sectional folding table as described in claim 1 and further comprising:

a first luggage-type wheel attached rotationally to the first side of the first-tabletop frame proximate an attachment side of the first-tabletop frame and having a rotational axis perpendicular to the first side of the first-tabletop frame; and a second luggage-type wheel attached rotationally to the second side of a first-tabletop frame proximate the attachment side of the first-tabletop frame and having a rotational axis perpendicular to the second side of the first-tabletop frame.

9. A sectional folding table as described in claim 8 and further comprising:

a first luggage strut attached to a bottom of the first side of the first-tabletop frame at a design distance from the attachment side of the first-tabletop frame;

a second luggage strut attached to a bottom of the second side of the first-tabletop frame at a design distance from the attachment side of the first-tabletop frame;

the first luggage strut and the second luggage strut having equal design lengths with ends of the first and the second luggage struts being at positions that are a design distance greater from the bottom side of the first-tabletop frame then are the outside peripheries of the first luggage-type wheel and the second luggage-type wheel, such that the first luggage-type wheel and the second luggage-type wheel are not in contact with a plane horizontal surface common to the ends of the first luggage strut and the second luggage strut when the joint side of a folded sectional folding table is resting on the plane horizontal surface common to the ends of the first luggage strut and the second luggage strut, and such that the first luggage-type wheel and the second luggage-type wheel are in contact with the plane horizontal surface common to the ends of the first luggage strut and the second luggage strut when the joint side of the folded sectional folding table is raised a design distance for wheel locomotion of the folded sectional folding table.

10. A sectional folding table as described in claim 9 and further comprising:

a third luggage strut attached to a bottom of the first side of the first-tabletop frame at a design distance from the joint side of the first-tabletop frame;

a fourth luggage strut attached to a bottom of the second side of the first-tabletop frame at a design distance from the joint side of the first-tabletop frame;

the third luggage strut and the fourth luggage strut having design length approximately equal to design lengths of the first luggage strut and the second luggage strut.

11. A sectional folding table as described in claim 1 and further comprising:

a first primary leg attached pivotally to the first-tabletop frame proximate a first attachment corner of the first-tabletop frame; and a second primary leg attached pivotally to the first-tabletop frame proximate a second attachment corner of the first-tabletop frame.

12. A sectional folding table as described in claim 11 wherein:

the first primary leg is attached pivotally to the first side of the first-tabletop frame; and the second primary leg is attached pivotally to the second side of the first-tabletop frame in an offset position relative to pivotal attachment of the first primary leg to the first side of the first-tabletop, such that the first primary leg and the second primary leg are juxtaposed in folded mode.

13. A sectional folding table as described in claim 1 and further comprising:

a leg-locking means with which select legs of the sectional folding table are lockable in design vertical and horizontal attitudes selectively.

14. A sectional folding table as described in claim 13 wherein:

the leg-locking means is a lock pin that is positional in matching pin orifices in a frame portion of a leg hinge and in a leg portion of a leg hinge.

15. A sectional folding table as described in claim 1 and further comprising:

a length-adjustment means on select legs of the sectional folding table.

16. A sectional folding table as described in claim 15 wherein:

the length-adjustment means is a leg extension that is a section of table leg that is positional telescopically inside of a portion of table leg that is attachable to the sectional folding table and lockable in telescopic length by fastener means for a design plurality of table legs that are attachable to the sectional folding table respectively.

17. A sectional folding table as described in claim 16 wherein:

the fastener means is a set screw that is threadable through a wall of a base portion of the table leg that is attachable to the sectional folding table and positional in arresting relationship to the leg extension for the design plurality of table legs that are attachable to the sectional folding table respectively.

* * * * *